US005447800A

United States Patent [19]

Dorsch et al.

[11] Patent Number: 5,447,800

[45] Date of Patent: Sep. 5, 1995

[54] MARTENSITIC HOT WORK TOOL STEEL DIE BLOCK ARTICLE AND METHOD OF MANUFACTURE

[75] Inventors: Carl J. Dorsch; Kenneth E. Pinnow, both of Pittsburgh; William Stasko, West Homestead, all of Pa.

[73] Assignee: Crucible Materials Corporation, Syracuse, N.Y.

[21] Appl. No.: 126,556

[22] Filed: Sep. 27, 1993

[51] Int. Cl.[6] ..... B22F 3/14; B22F 3/16

[52] U.S. Cl. ..... 428/552; 428/546; 428/551; 419/38; 419/42; 419/43; 419/49; 419/54; 419/55; 420/87; 420/104; 420/105; 420/124

[58] Field of Search ..... 428/546, 551, 552; 420/87, 104, 105, 124; 419/38, 42, 43, 49, 54, 55

[56] References Cited

U.S. PATENT DOCUMENTS

| | | | |
|---|---|---|---|
| 3,615,905 | 10/1971 | Omsen et al. | 148/609 |
| 4,287,007 | 9/1981 | Vander Voort | 148/334 |
| 4,353,756 | 10/1982 | Vander Voort | 148/663 |
| 4,765,836 | 8/1988 | Hauser et al. | 75/241 |
| 4,769,213 | 9/1988 | Haswell, Jr. et al. | 420/61 |
| 4,886,640 | 12/1989 | Garner, Jr. et al. | 420/111 |
| 5,188,659 | 2/1993 | Purnell | 75/246 |
| 5,238,482 | 8/1993 | Stasko et al. | 75/338 |

FOREIGN PATENT DOCUMENTS 0545884 6/1993 European Pat. Off. .

OTHER PUBLICATIONS

Pinnow et al., "P/M Tool Steels" Metals Handbook, vol. 1, 10th Ed.: Properties and Selection (1989).

Cocks, D. J., "Longer Die Life from H13 Die Casting Dies by the Practical Application of Recent Research Results" ADCI TechData No. 01-88-01D (1988).

Wallace et al., "Influence of Cooling Rate on the Microstructure and Toughness of Premium H-13 Die Steels" 15th Die Casting Congress & Exposition , Oct. 16-19, 1989, St. Louis, Mo., Paper No. G-T89-013.

Dorsch et al., "The Effects of DCM on the Surface of Hardened H-13 Die Components" 15th Die Casting Congress & Exposition, Oct. 16-19, 1989, St. Louis, Mo., Paper No. G-T89-031.

Du et al., "The Effects of Sulfur Content on the Performance of H-13 Steel" Die Casting Research Foundation, Inc., Techdata Digest No. 01-83-01D.

*Primary Examiner*—Donald P. Walsh
*Assistant Examiner*—John N. Greaves
*Attorney, Agent, or Firm*—Finnegan, Henderson, Farabow, Garrett & Dunner

[57] ABSTRACT

A martensitic hot work tool steel die block for use in the manufacture of die casting die components and other hot work tooling components and a method for manufacturing the same. The article has a hardness within the range of 35 to 50 HRC and a minimum transverse Charpy V-notch impact toughness of 5 foot pounds when heat treated to a hardness of 44 to 46 HRC and when tested at both 72° F. and 600° F. The article is a hot worked, heat treated and fully dense consolidated mass of prealloyed particles of the composition, in weight percent, 0.32 to 0.45 carbon, 0.20 to 2.00 manganese, 0.05 to 0.30 sulfur, up to 0.03 phosphorous, 0.80 to 1.20 silicon, 4.75 to 5.70 chromium, 1.10 to 1.75 molybdenum, 0.80 to 1.20 vanadium, and balance iron. The alloy may be any conventional wrought AISI hot work tool steel or wrought maraging or precipitation-hardening steel having 0.05 to 0.30 percent sulfur, and having sulfide particles which exhibit a maximum size of 50 microns in their longest dimension. The article is manufactured by compacting of prealloyed particles of the aforementioned composition followed by hot working, annealing, hardening and tempering.

13 Claims, 9 Drawing Sheets

MARTENSITIC HOT WORK TOOL STEEL DIE BLOCK ARTICLE AND METHOD OF MANUFACTURE

BACKGROUND OF THE INVENTION

1. Field of the Invention

The invention relates to a highly machinable, prehardened, martensitic steel article used for metal die casting die components and other hot work tooling components, and to a method for producing the same.

2. Discussion of the Related Art

The typical method of manufacture of die components used for die casting, including light metals such as aluminum, and for other types of hot work tooling components consists of rough machining the component close to finish dimensions from a hot work tool steel die block, hardening the rough-machined component by a quenching and tempering type of heat treatment, and finally machining the hardened component to finish dimensions. The performance and longevity of die components so manufactured are significantly affected by two features of this manufacturing procedure, namely, the quenching rate employed to harden the component[1/2/] and the technique used to finish machine the component.[3/] For AISI hot work tool steels, rapid quenching rates are required to produce the martensitic microstructure necessary for long service life. Slow quenching rates minimize size change and distortion of the rough-machined component, and thereby reduce the amount, severity, and cost of the finish machining operation. The slow quenching rates, however, also reduce service life, because they introduce nonmartensitic constituents into the microstructure of the steel. The size change and distortion of quenched, rough-machined die components can be eliminated while maintaining the optimum, rapidly-quenched, martensitic microstructure by manufacturing the die components from prehardened hot work tool steel die blocks.

[1/] Cocks, D. L., "Longer Die Life from H13 Die Casting Dies by the Practical Application of Recent Research Results," Die Casting Research Foundation (now the North American Die Casting Association), Techdata Digest No. 01-88-01D, Apr., 1988.

[2/] Wallace, J. F., et al., "Influence of Cooling Rate on the Microstructure and Toughness of Premium H-13 Die Steels," Transactions Of the North American Die Casting Association 15th International Congress, Oct. 16≠19, 1989, Paper G-T89-013.

[3/] Dorsch, C. J. and Nichols, H. P., "The Effect of EDM on the Surface of Hardened H-13 Die Components," Transactions of the North American Die Casting Association 15th International Die Casting Congress, Oct. 16–19, 1989, Paper G-T89-031.

Prehardened die blocks made from conventional, resulfurized AISI H13 hot work tool steel are currently available. The sulfur additions in the steel make it machinable at the high hardness needed for die casting applications (35 to 50 HRC), but die components manufactured from the currently available prehardened die blocks exhibit short service life because the sulfur in the steel reduces thermal fatigue resistance and impact toughness, which in turn reduce die performance and die service life. [4/] FIGS. 1 and 2 are excerpted from this reference[4/] and show the detrimental effect of higher sulfur content on the thermal fatigue resistance of AISI H13 hot work tool steel. Similarly, FIG. 3 is also from this reference and shows the detrimental effect of increasing sulfur content on the dynamic fracture toughness of AISI H13. This reference concludes that: "Higher sulfur levels of the H-13 steels above 0.028% reduce thermal fatigue resistance. The fracture toughness of H-13 steel hardened for use in die casting dies is reduced steadily by raising the sulfur content of the steel from 0.003 to 0.008 to 0.014 to the 0.028–0.075%S range. This behavior is attributed to the effect of the inclusions produced by higher sulfur levels." In response to the results of the work in the referenced literature, and because of the significant economic impact which results from reduced thermal fatigue resistance in die casting dies, the North American Die Casting Association has limited the sulfur content of AISI H13 which is considered to be of premium quality for die casting die applications to a maximum of 0.005 weight per cent.

[4/] Pixi Du and J. F. Wallace, "The Effects of Sulfur on the Performance of H-13 Steel," Die Casting Research Foundation (now the North America Die Casting Association), Techdata Digest Number 01-83-01D, 1983.

The potential industry wide cost savings which could result from the use of highly machinable, prehardened die blocks is offset by the reduction in die component life which is inherent in the currently available prehardened die blocks. A need therefore exists for a highly machinable, prehardened, martensitic hot work tool steel die block that can be used without sacrificing die performance and longevity.

OBJECT OF THE INVENTION

It is a primary object of the present invention to provide a highly machinable, prehardened, martensitic hot work tool steel die block which may be used to manufacture die casting die components and other hot work tooling components having an improved combination of impact toughness, machinability, and thermal fatigue resistance.

Another related object of the invention is to provide a method for producing a highly machinable, prehardened, martensitic steel die block having these characteristics by compaction, hot working, and heat treatment of prealloyed powder which contains intentional additions of sulfur.

SUMMARY OF THE INVENTION

In accordance with the invention there is provided a martensitic hot work tool steel die block article that is adapted for use in the manufacture of die casting components and other hot work tooling components. The article has a hardness within the range of 35 to 50 HRC, and a minimum transverse Charpy V-notch impact toughness of 5 foot pounds when heat treated to a hardness of 44 to 46 HRC and when tested at both 72° F. and 600° F. The article is a hot worked, heat treated and fully dense consolidated martensitic hot work tool steel mass of prealloyed particles having 0.05 to 0.30 weight percent sulfur. Preferably, the article has sulfide particles with a maximum size of 50 microns in their longest direction. The article preferably consists essentially of, in weight percent, 0.32 to 0.45 carbon, 0.20 to 2.00 manganese, 0.05 to 0.30 sulfur preferably 0.15 to 0.30, up to 0.03 phosphorous, 0.80 to 1.20 silicon, 4.75 to 5.70 chromium, 1.10 to 1.75 molybdenum, 0.80 to 1.20 vanadium, balance iron and incidental impurities, as set forth in Table I.

TABLE I

| | |
|---|---|
| Carbon | 0.32–0.45 |
| Manganese | 0.20–2.00 |
| Sulfur | 0.05–0.30, preferably 0.15 to 0.30 |
| Phosphorus | 0.03 max |
| Silicon | 0.80–1.20 |
| Chromium | 4.75–5.70 |
| Molybdenum | 1.10–1.75 |
| Vanadium | 0.80–1.20 |

TABLE I-continued

| | |
|---|---|
| Iron | Balance |

Alternately, the prealloyed particles may comprise a chemical composition of a wrought AISI hot work tool steel to which sulfur has been added within the range of 0.05 to 0.30 weight percent. In addition, the prealloyed particles may comprise a wrought maraging or precipitation-hardening steel suitable for use as die casting components and other hot work tooling components and to which sulfur has been added within the range of 0.05 to 0.30 weight percent.

With the use of prealloyed particles, the sulfur is uniformly distributed therein and thus the resulting sulfides in the fully dense consolidated mass of the prealloyed particles are small, and uniformly distributed, and most of them are generally spherical. Preferably, the maximum size of the sulfides in the consolidated articles produced in accordance with the invention is less than about 50 microns in their longest dimension. Thus, the segregation of sulfur that is inherent within cast ingots of AISI H13 and other conventional wrought steels is eliminated to in turn avoid the presence of conventional, relatively thick, elongated, sulfide stringers in die blocks forged from these ingots.

The prealloyed particles may be produced by gas atomization of the desired composition with the presence of sulfur within the limits of the invention as defined herein. By the use of gas atomization, spherical particles of the character preferred for use in the practice of the invention are achieved. Nitrogen is the preferred atomizing gas.

In accordance with the invention, a highly machinable, prehardened, martensitic hot work tool steel die article, such as a die block, which may be used for die casting die components and other hot work tooling components, is manufactured by compaction of the prealloyed particles to full density from a compact, hot working the compact to a desired shape, and heat treatment. The heat treatment may comprise annealing, hardening by heating and cooling to produce a martensitic structure and subsequent tempering that includes at least a double tempering treatment with intermediate cooling to ambient temperature.

In accordance with a preferred embodiment of the invention, sulfur in a quantity of 0.05 to 0.30 weight percent, preferably 0.15 to 0.30 percent, is added to molten steel of a composition suitable for use in the practice of the invention. The molten steel is then nitrogen-gas atomized to produce prealloyed powder. The powder is loaded into low-carbon steel containers, which are hot outgassed and then sealed by welding. The filled containers are compacted to full density by hot isostatic pressing for up to 12 hours within a temperature range of 1800° to 2400° F., and at a pressure in excess of 10,000 psi. Following hot isostatic pressing, the compacts are hot worked as by forging and/or rolling to slabs and billets using a working temperature range of 1800° to 2250° F. The forged products are annealed by heating to a temperature between 1550° and 1700° F. for about 1 hour per inch of thickness for a minimum of two hours, and cooling to room temperature at a rate less than 50° F. per hour. The annealed blocks are hardened by heating to a temperature between 1800° and 1950° F. for about ½-hour per inch of thickness, and quenching to about 150° F. at a minimum rate of 20° F. per minute to produce a martensitic structure. Upon reaching a temperature of about 150° F., the blocks are immediately double tempered within a temperature range of 1000° to 1200° F. for about 1 hour per inch of thickness and for a minimum of 2 hours plus 2 hours, with cooling to ambient temperature between tempers. Remnants of the low-carbon steel container are removed from the blocks by machining after heat treatment.

The "AISI hot work tool steels" are defined as and encompass the chromium-molybdenum hot work steels such as H10, H11, and H12 which contain, in weight percent, 0.30 to 0.60 carbon, 0.10 to 2.0 manganese, up to 0.03 phosphorus, 0.30 to 2.0 silicon, 2.0 to 6.0 chromium, 0.20 to 1.50 vanadium, 0.75 to 3.50 molybdenum, up to 2.0 niobium, balance iron and incidental impurities; the chromium-tungsten hot work steels such as H14, H16, H19, and H23, which contain, in weight percent, 0.30 to 0.60 carbon, 0.10 to 2.0 manganese, up to 0.03 phosphorus, 0.30 to 2.0 silicon, 2.0 to 13.0 chromium, 0.20 to 2.50 vanadium, 3.0 to 13.0 tungsten, 0.10 to 2.0 molybdenum, 0.50 to 5.0 cobalt, up to 4.0 niobium, balance iron and incidental impurities; the tungsten hot work steels such as H20, H21, H22, H24, H25, and H26, which contain, in weight percent, 0.20 to 0.60 carbon, 0.10 to 2.0 manganese, up to 0.03 phosphorus, 0.10 to 1.0 silicon, 2.0 to 6.0 chromium, up to 3.0 nickel, 0.10 to 2.0 vanadium, 5.0 to 20.0 tungsten, up to 3.0 molybdenum, up to 4.0 cobalt, up to 3.0 niobium, balance iron and incidental impurities; and the molybdenum hot work steels such as H15, H41, H42, and H43, which contain, in weight percent, 0.10 to 0.70 carbon, 0.10 to 2.0 manganese, 0.10 to 1.0 silicon, 2.0 to 6.0 chromium, up to 3.0 nickel, 0.50 to 3.0 vanadium, up to 8.0 tungsten, 4.0 to 10.0 molybdenum, up to 26.0 cobalt, up to 3.0 niobium, balance iron and incidental impurities.

"Maraging and precipitation-hardening steels" are defined as steels which exhibit a soft, martensitic microstructure after cooling from a solution annealing treatment at a temperature in excess of 1500° F., and which are hardened to a hardness in excess of 35 HRC by heating to a temperature in excess of 900° F. and holding at that temperature for a minimum time of 1 hour. Maraging steels and precipitation-hardening steels which are suitable for use as die casting die components and other hot work tooling components consist of, in weight percent, up to 0.20 carbon, up to 1.0 manganese, up to 0.04 phosphorus, up to 0.50 silicon, up to 19.0 nickel, up to 18.0 chromium, up to 8.0 molybdenum, up to 6.0 tungsten, up to 11.0 cobalt, up to 4.0 copper, up to 2.0 niobium, up to 2.0 titanium, up to 2.0 aluminum, balance iron and incidental impurities.

DETAILED DESCRIPTION OF THE PREFERRED EMBODIMENTS

The currently available prehardened hot work tool steel die blocks are made using conventional ingot metallurgy. As such, the steel is melted and is cast into ingot molds to produce ingots which weigh in excess of 1000 pounds. If the steel contains more than about 0.010 weight percent sulfur, the sulfur segregates toward the center of the ingot and combines with other elements in the steel to form discrete sulfur-rich particles (sulfides) as the molten steel solidifies. The resultant ingot thus contains a nonuniform distribution of sulfur. The sulfide particles are malleable, and when the solidified ingot is subsequently hot forged or hot rolled, they become elongated parallel to the direction of forging and/or rolling. The sulfide stringers so produced become more numerous and thicker with increasing sulfur content in the steel.

Figure 1:
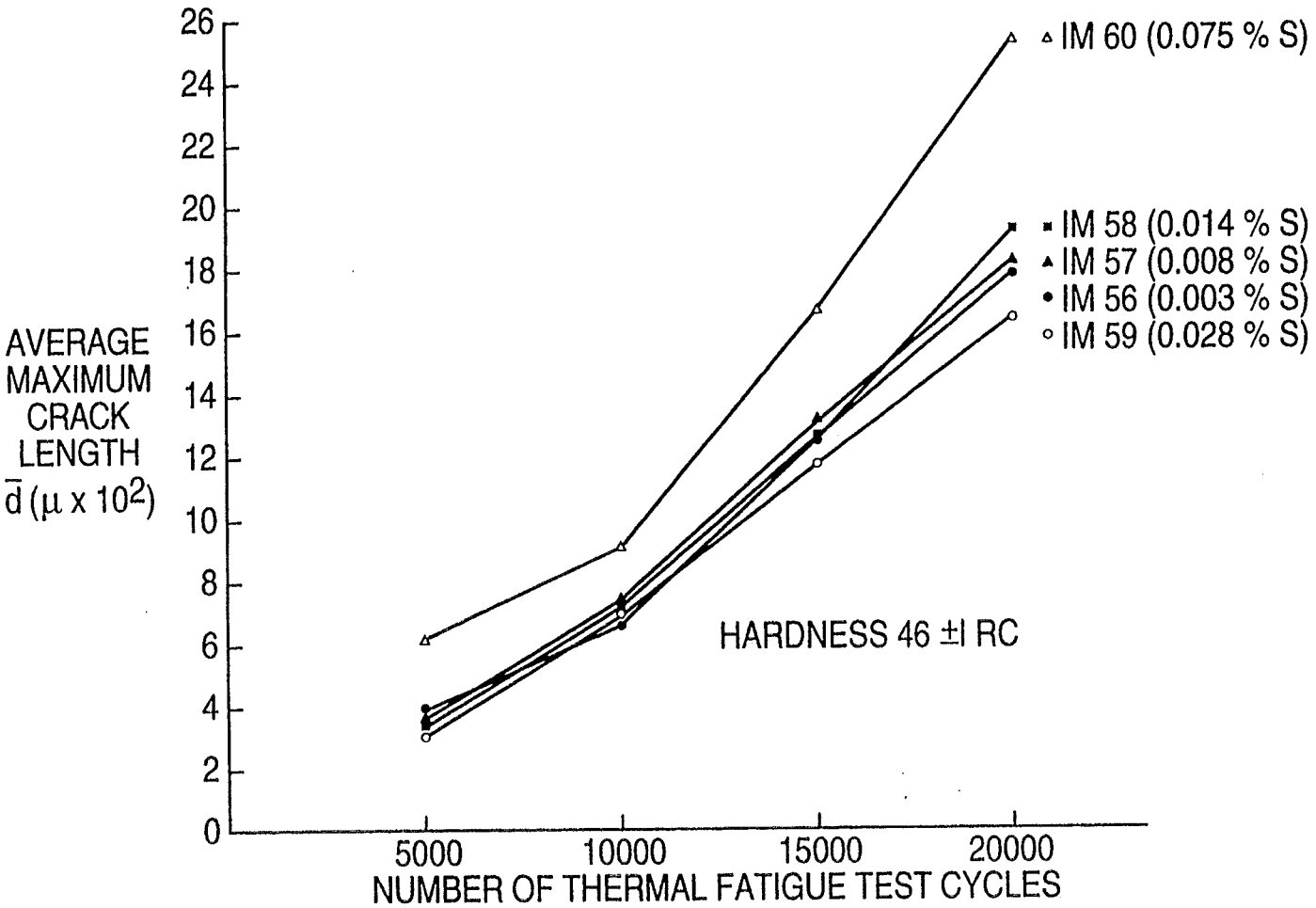
FIG. 1 is a graph showing the detrimental effect of increasing sulfur content on the thermal fatigue resistance of conventionally-produced AISI H13 as measured by average maximum crack length.
Figure 2:
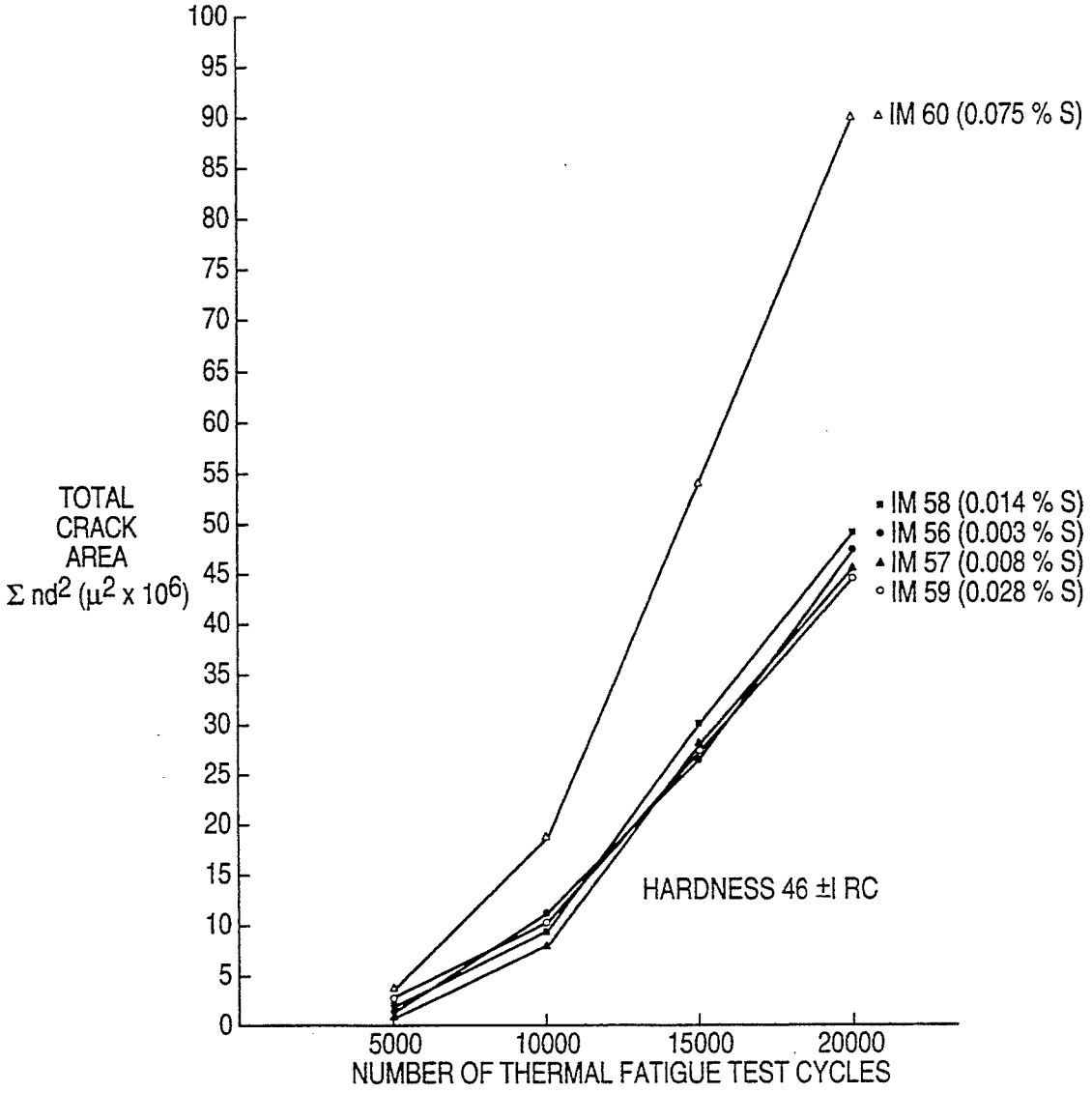
FIG. 2 is a graph showing the detrimental effect of increasing sulfur content on the thermal fatigue resistance of conventionally-produced AISI H13 as measured by total crack area.
Figure 3:
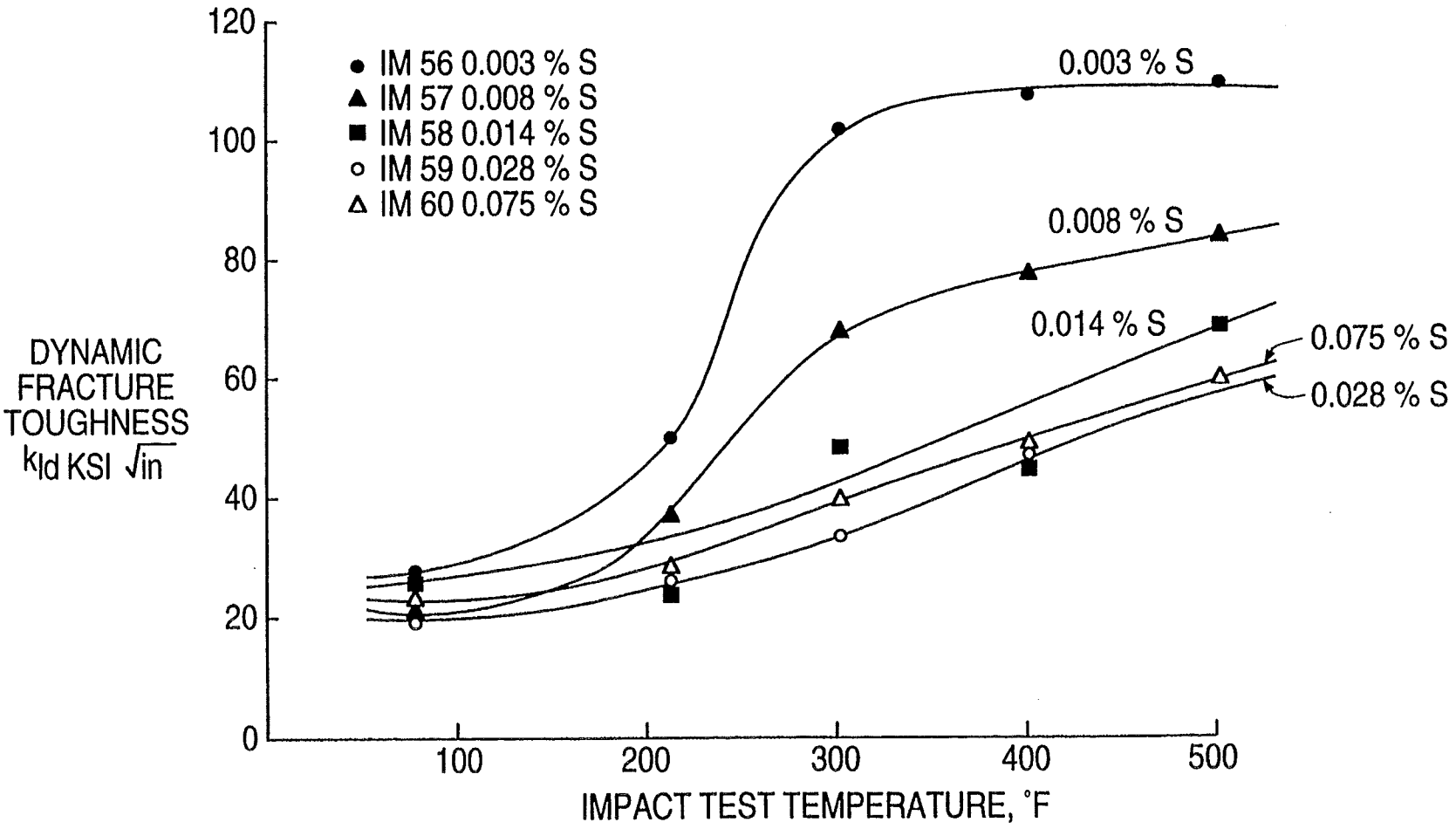
FIG. 3 is a graph showing the detrimental effect of increasing sulfur content on the dynamic fracture toughness of conventionally-produced AISI H13.
Figure 4A:
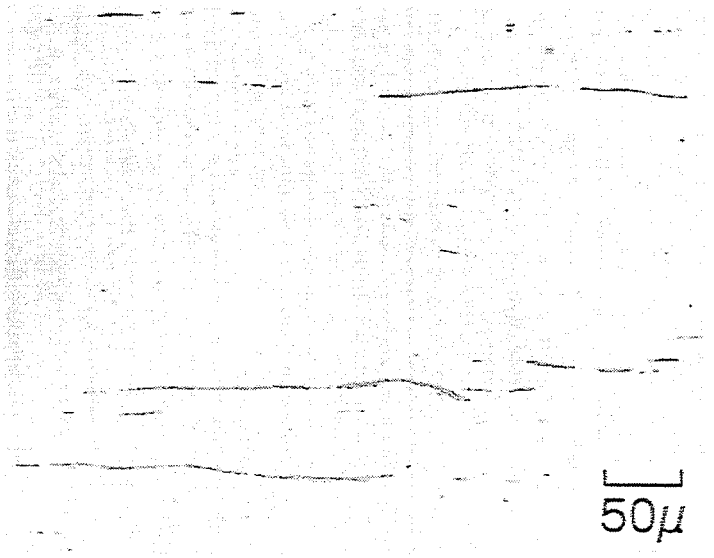
FIGS. 4*a* and 4*b* are photomicrographs at magnifications of 200× and 500×, respectively, showing the microstructure of a conventionally-produced, resulfurized, hot work tool steel die block.
Figure 4B:
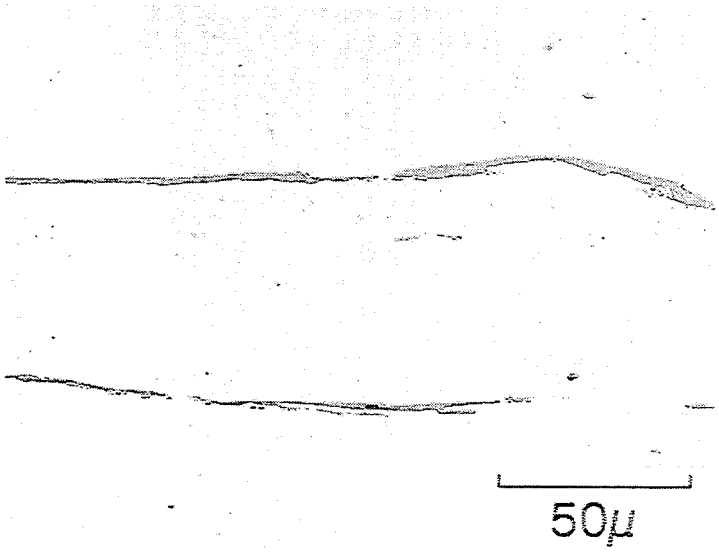

For prehardened hot work tool steel die blocks, a sulfur content of about 0.10 weight percent or more is necessary to make the steel machinable by conventional chip-making methods at the relatively high hardness needed for hot work tooling applications (35 to 50 HRC). At this sulfur level, the sulfide stringers which form in the die blocks are both very numerous and very thick, as evidenced by FIG. 4. FIGS. 4*a* and 4*b* are photomicrographs of the microstructure of a conventional, prehardened, hot work tool steel die block. It is the presence of these numerous sulfides that results in the high machinability of the hardened die block, but their length, width and shape causes a reduction in the impact toughness and thermal fatigue resistance of components manufactured from such a die block.

To eliminate the nonuniform distribution and minimize the size of the sulfide particles, and thereby minimize their negative effects on impact toughness and thermal fatigue resistance, the die blocks can be made by compaction, hot working, and heat treatment of prealloyed powder which contains the high sulfur level necessary for good machinability in the hardened condition. In addition, using the method of manufacture in accordance with the invention, sulfur levels even higher than that of the currently available prehardened hot work tool steel die blocks may be used to further improve the machinability of the hardened die blocks without reducing impact toughness or thermal fatigue resistance.

To demonstrate the principles of the invention, a series of experimental die blocks were made and subjected to mechanical, machinability, and thermal fatigue tests. A commercial, conventional, prehardened, hot work tool steel die block was simultaneously subjected to the same tests for comparison. The chemical compositions of the experimental die blocks and the commercial, conventional, prehardened die block are given in Table II.

TABLE II

| COMPOSITIONS OF PREHARDENED DIE BLOCK STEELS, WEIGHT % | | | | | | | | | | | |
|---|---|---|---|---|---|---|---|---|---|---|---|
| GRADE | DIE BLOCK | C | Mn | P | S | Si | Cr | Mo | V | O | N |
| H13 | 90-11 | 0.35 | 0.31 | 0.011 | 0.075 | 0.96 | 5.51 | 1.32 | 0.95 | 0.0100 | 0.023 |
| H13 | 90-12 | 0.35 | 0.34 | 0.008 | 0.15 | 0.99 | 5.70 | 1.29 | 0.99 | 0.0102 | 0.026 |
| H13 | 92-130 | 0.35 | 0.80 | 0.010 | 0.16 | 1.01 | 5.11 | 1.27 | 0.98 | 0.0096 | 0.007 |
| H13 | 92-131 | 0.36 | 1.56 | 0.011 | 0.15 | 1.07 | 5.19 | 1.29 | 1.00 | 0.0094 | 0.007 |
| H13 | 91-20 | 0.38 | 0.85 | 0.006 | 0.30 | 1.05 | 4.97 | 1.33 | 1.05 | 0.0042 | 0.007 |
| H13 | 90-64 | 0.38 | 0.72 | 0.020 | 0.14 | 0.94 | 5.20 | 1.36 | 1.06 | — | — |
| | | | (Conventional Die Block) | | | | | | | | |
| H11 | 92-44 | 0.35 | 0.38 | — | 0.15 | 0.99 | 5.14 | 1.42 | 0.51 | 0.0080 | 0.003 |
| H10 | 92-45 | 0.42 | 0.63 | 0.014 | 0.16 | 0.98 | 3.33 | 2.62 | 0.37 | 0.0070 | 0.002 |
| H10 | 92-46 | 0.42 | 0.89 | 0.014 | 0.27 | 1.03 | 3.35 | 2.63 | 0.39 | 0.0180 | 0.004 |

The experimental die blocks were made from 100-pound induction-melted heats which were nitrogen gas atomized to produce prealloyed powder. Powder from each heat was screened to a −16 mesh size (U.S. Standard) and was loaded into a 4½-inch-diameter by 8-inch-long low-carbon steel container. Each container was hot outgassed and was sealed by welding. The compacts were hot isostatically pressed for 4 hours at 2165° F. and 14500 psi. and were cooled to ambient temperature. The compacts were then forged to 3-inch-wide by 1-inch-thick die blocks.

Several tests were conducted to compare the advantages of the die blocks of the invention with those of a currently available, commercial, prehardened die block, and to demonstrate the significance of their composition and method of manufacture. Tests were conducted to illustrate the effects of composition and method of manufacture on microstructure, impact toughness, machinability, and thermal fatigue resistance. Specimens for the various laboratory tests were cut from the die blocks of the invention and were hardened. The H13 and H11 specimens were hardened by austenitizing for 30 minutes at 1875° F. and forced-air quenching to about 150° F. They were then double tempered for 2 hours plus 2 hours at 1120° F. The H10 specimens were hardened by austenitizing for 30 minutes at 1875° F. and oil quenching to about 150° F. They were then double tempered for 2 hours plus 2 hours at 1165° F. All test specimens were finish machined after heat treatment. Specimens from the commercial, prehardened die block were cut and finish machined directly from the block.

Figure 5A:
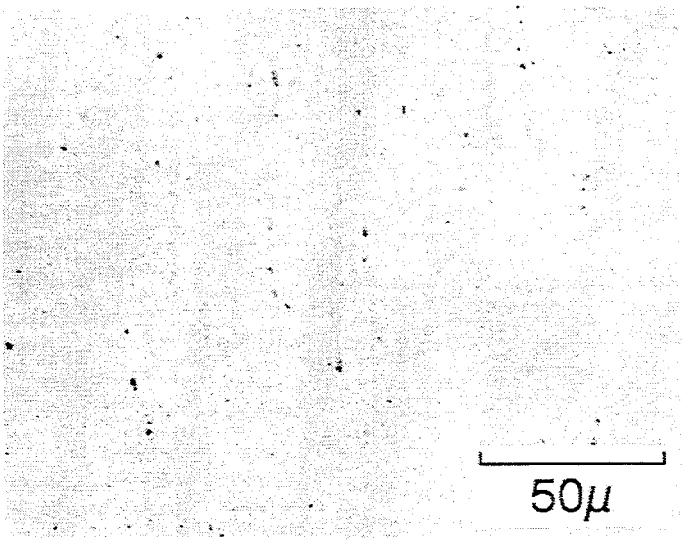
FIGS. 5*a*, 5*b*, and 5*c* are photomicrographs at a magnification of 500× showing the microstructure of hot work tool steel die blocks in accordance with the invention with sulfur contents of 0.075%, 0.15%, and 0.30%, respectively.
Figure 5B:
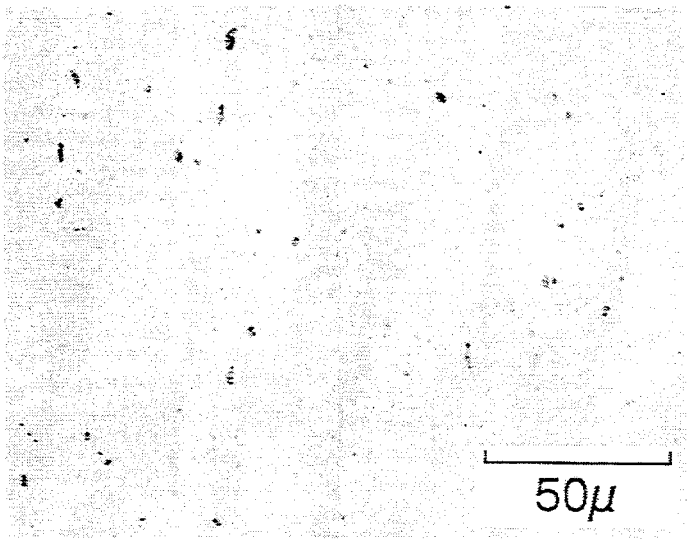
Figure 5C:
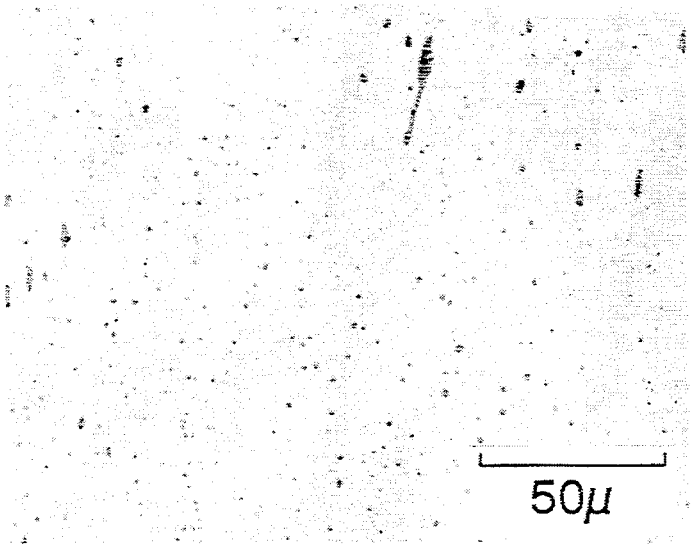
Figure 6A:
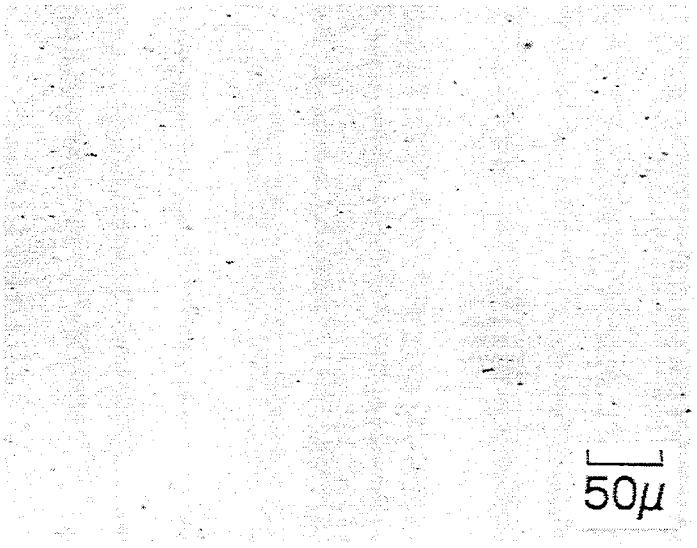
FIGS. 6*a*, 6*b*, and 6*c* are photomicrographs at a magnification of 200× showing that the maximum size of the sulfide particles in the hot work tool steel die blocks in accordance with the invention is less than 50 microns.
Figure 6B:
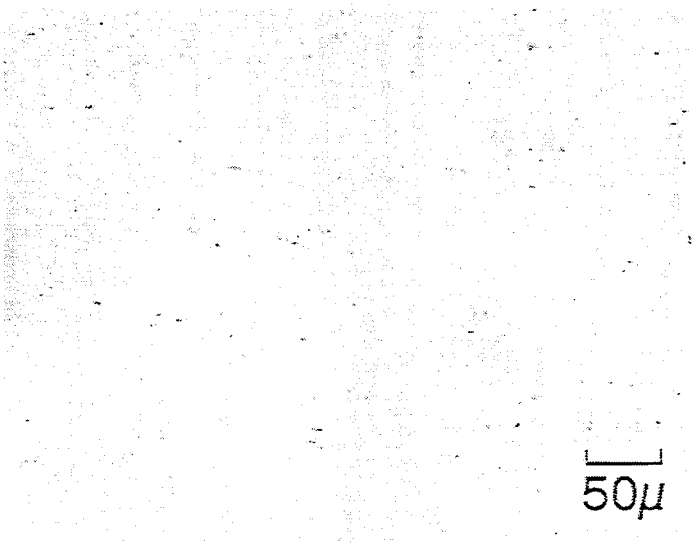
Figure 6C:
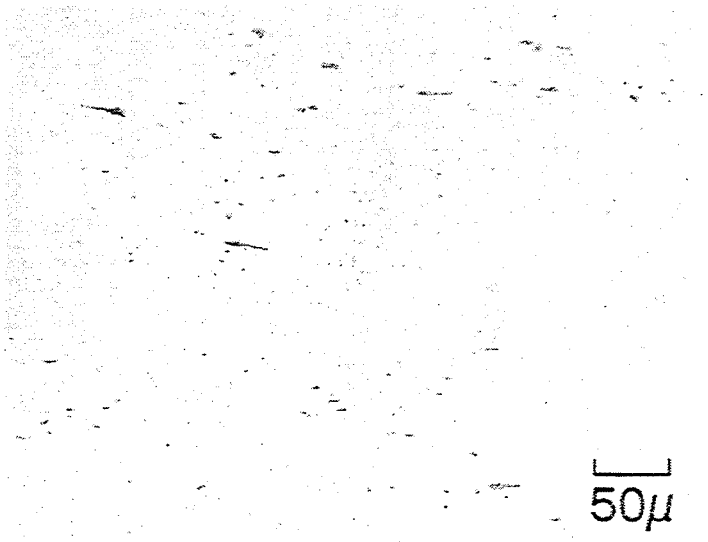

The microstructures of die blocks of the invention are presented in FIGS. 5 and 6. Comparison with the microstructure of the commercial, prehardened die block shown in FIG. 4 shows that the sulfides in the die blocks of the invention are smaller, more uniformly distributed, and are generally more spherical in shape. FIG. 6 shows that the sulfides in the die blocks of the invention are all less than 50 microns in their longest dimension.

Figure 7:
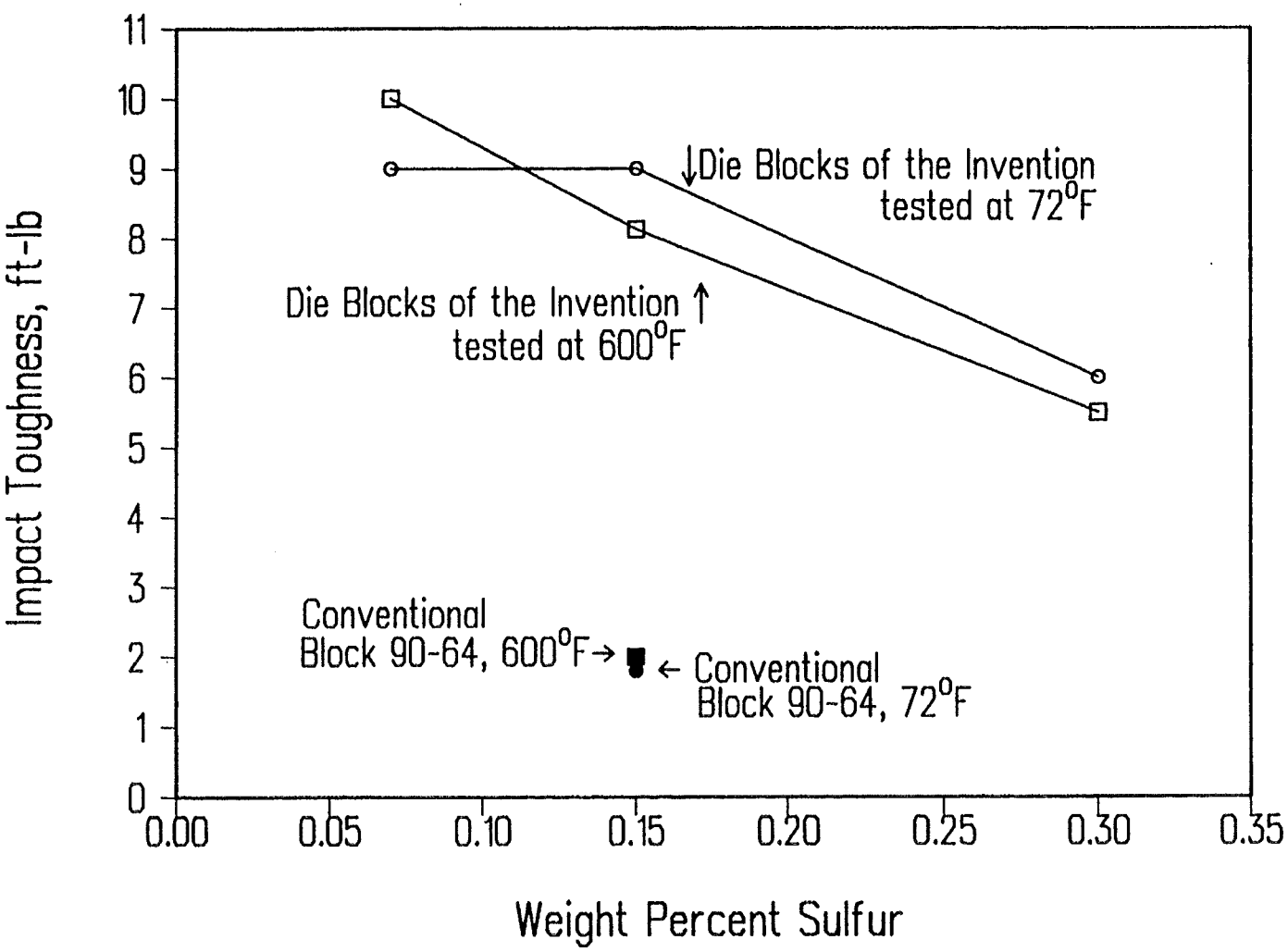
FIG. 7 is a graph showing the results of Charpy V-notch impact tests on samples of a conventional hot work tool steel die block and samples in accordance with the invention.

The results of impact tests conducted on the die blocks of the invention and on the commercial, prehardened die block are given in Table III and in FIG. 7.

TABLE III

NOTCH TOUGHNESS OF DIE BLOCKS OF THE INVENTION AND A COMMERCIAL, PREHARDENED DIE BLOCK

| GRADE | DIE BLOCK | WT % SULFUR | HARDNESS ROCKWELL C | ORIENTATION | CHARPY V-NOTCH IMPACT TOUGHNESS, ft-lb 72° F. TEST VALUES | AVG. | 600° F. TEST VALUES | AVG. |
|---|---|---|---|---|---|---|---|---|
| H13 | 90-11 | 0.075 | 46 | TRANSVERSE | 10, 10, 7 | 9 | 9, 10, 11 | 10 |
| H13 | 90-12 | 0.15 | 46 | TRANSVERSE | 10, 8, 9 | 9 | 8, 8, 9 | 8.3 |
| H13 | 92-130 | 0.16 | 45 | TRANSVERSE | 10.5. 8.5, 10.5 | 9.8 | 8, 7, 8 | 7.6 |
| H13 | 92-131 | 0.15 | 45 | TRANSVERSE | 9.5. 10, 7 | 8.8 | 9.5, 8, 8 | 8.5 |
| H13 | 91-20 | 0.30 | 46 | TRANSVERSE | 6, 6, 6 | 6 | 5, 6, 5.5 | 5.5 |
| | | | | Conventional | | | | |
| H13 | 90-64 | 0.14 | 44.5 | TRANSVERSE | 2, 2, 1.5 | 1.8 | 2, 2, 2 | 2 |
| H11 | 92-44 | 0.15 | 45 | TRANSVERSE | 10.5, 11.5, 11.5 | 11.2 | 9, 9, 9 | 9 |
| H10 | 92-45 | 0.16 | 45 | TRANSVERSE | 8.5, 8, 8 | 8.2 | 7, 7, 7 | 7 |
| H10 | 92-46 | 0.27 | 45 | TRANSVERSE | 6.5, 6.5, 6.5 | 6.5 | 6, 6, 6 | 6 |

These test results show that the notch toughness of the die blocks of the invention, as measured in the Charpy V-notch impact test, are clearly superior to those of the commercial, prehardened die block (Block 90-64). Impact specimens having a transverse orientation with respect to the original die blocks were tested because the transverse orientation traditionally exhibits the lowest notch toughness, and as such, the greatest propensity for catastrophic failure in hot work tooling components. The tests conducted at 600° F. simulate the temperature experienced by die components in the die casting of aluminum alloys. FIG. 7 shows the effect of increasing sulfur content on the room temperature notch toughness of die blocks of the invention in comparison with the notch toughness of the commercial, prehardened die block. As shown, increasing sulfur content decreases notch toughness in the die blocks of the invention, but the invention permits a threefold improvement in notch toughness at twice the sulfur level of the commercial, prehardened die block.

Prehardened, resulfurized die blocks made from AISI Hll and AISI H10 are not commercially available. Therefore, samples of these die blocks are not available for direct comparison with the die blocks of the invention. The impact test data in Table III for die blocks of the invention that are based upon the AISI Hll and AISI H10 compositions show that when these steels are produced in accordance with the invention, the resultant notch toughness is superior to that of the commercial, prehardened die block made from AISI H13 hot work steel. The addition of sulfur to conventionally-produced AISI Hll, AISI H10, other AISI hot work tool steels, and maraging or precipitation-hardening steels would be expected to result in the same deleterious effects upon notch toughness and thermal fatigue resistance as those caused by sulfur additions in conventionally-produced AISI H13, because the ingot segregation and the formation and morphology of the sulfide particles would be similar in die blocks made from all of these materials. Thus, the test data for the die blocks of the invention which are based upon the compositions of AISI Hll and AISI H10 hot work steels demonstrate that the principles of the invention are applicable to all of the AISI hot work tool steels and the maraging or precipitation-hardening steels suitable for use as hot work tooling components.

Figure 8:
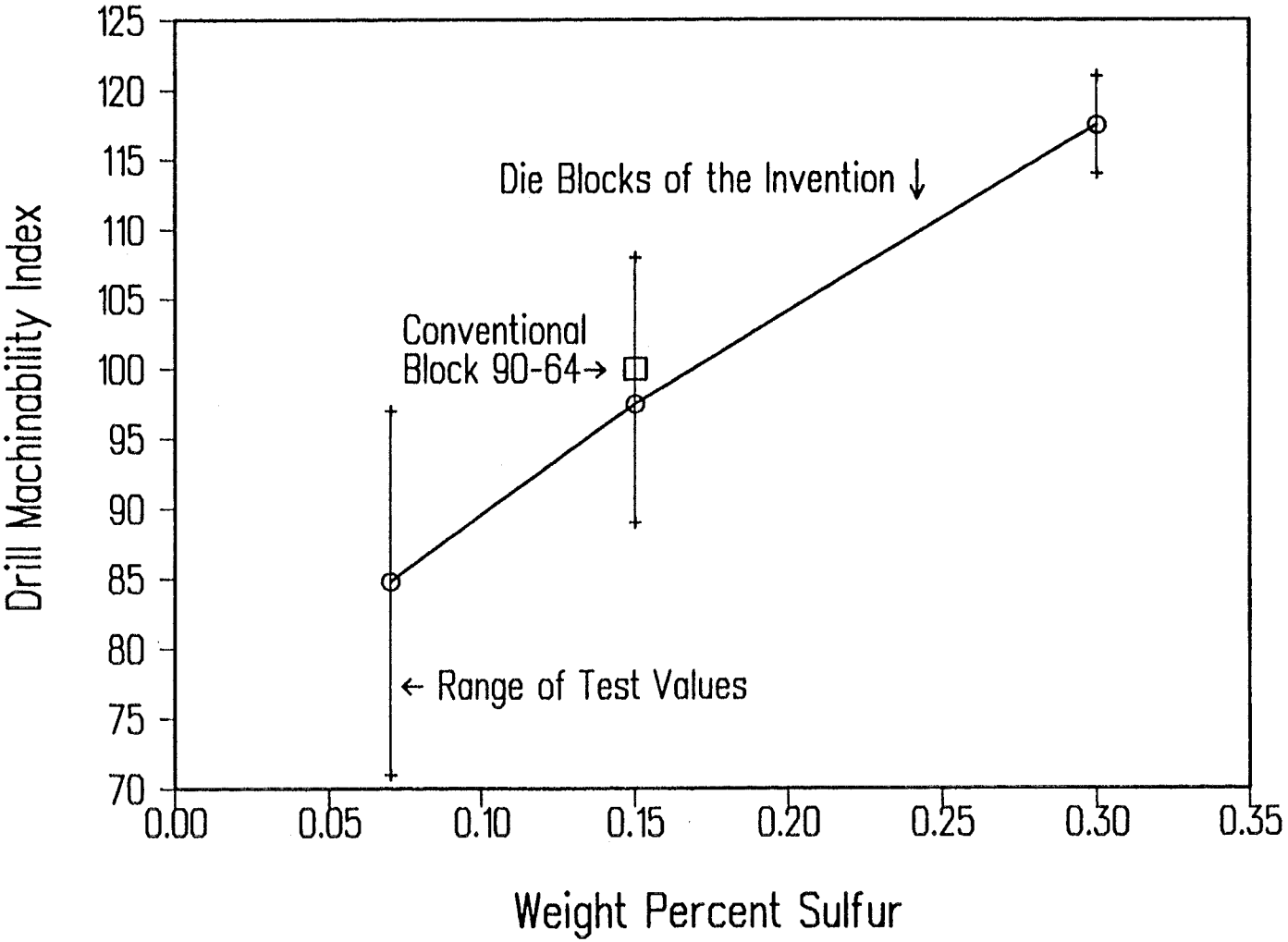
FIG. 8 is a graph showing the results of drill machinability tests on samples of a conventional hot work tool steel die block and samples in accordance with the invention.

The results of drill machinability tests conducted on the die blocks of the invention and on the commercial, prehardened die block are given in Table IV and in FIG. 8.

TABLE IV

DRILL MACHINABILITY INDEXES FOR DIE BLOCKS OF THE INVENTION AND A COMMERCIAL, PREHARDENED DIE BLOCK

| DIE BLOCK | Wt. % SULFUR | HARDNESS ROCKWELL C | DRILL MACHINABILITY INDEX TEST RESULTS | | | | | | AVERAGE |
|---|---|---|---|---|---|---|---|---|---|
| 90-11 | 0.075 | 44.5 | 86 | 85 | 71 | 97 | 74 | 96 | 84.8 |
| 90-12 | 0.15 | 44.5 | 94 | 96 | 89 | 100 | 89 | 108 | 97.5 |
| 92-130 | 0.16 | 44.5 | 94 | 99 | 95 | | | | 96 |
| 92-131 | 0.15 | 44.5 | 98 | 101 | 96 | | | | 98.3 |
| 91-20 | 0.30 | 44.5 | 115 | 114 | 117 | 121 | 119 | 119 | 117.5 |
| 90-64 | 0.14 | 44.5 | TEST STANDARD | | | | | | 100 (Commercial Die Block) |

The machinability indexes given in this Table IV and FIG. 8 were obtained by comparing the times required to drill holes of the same size and depth in the die blocks of the invention and in the commercial, prehardened die block and by multiplying the ratios of these times by 100. Indexes greater than 100 indicate that the drill machinability of the die block of the invention is greater than that of the commercial, prehardened die block. Indexes between about 95 and 105 indicate that the drill machinability of the test specimen is about comparable to that of the test standard. FIG. 8 shows the effect of increasing sulfur content in the die blocks of the invention in comparison with that of the commercial, prehardened die block. This figure also shows that increasing sulfur content also reduces the scatter in the machinability test data, which indicates more consistent machinability throughout the die block. Thus, prehardened die blocks of the invention which contain in excess of 0.15 weight percent sulfur would be expected to exhibit more consistent and reproducible machinability than that of the currently available, commercial, prehardened die blocks. Therefore, the preferred range for the sulfur content in the die blocks of the invention is 0.15 to 0.30 weight percent inclusive. Sulfur levels within this range provide the best combination of machinability and notch toughness.

Figure 9:
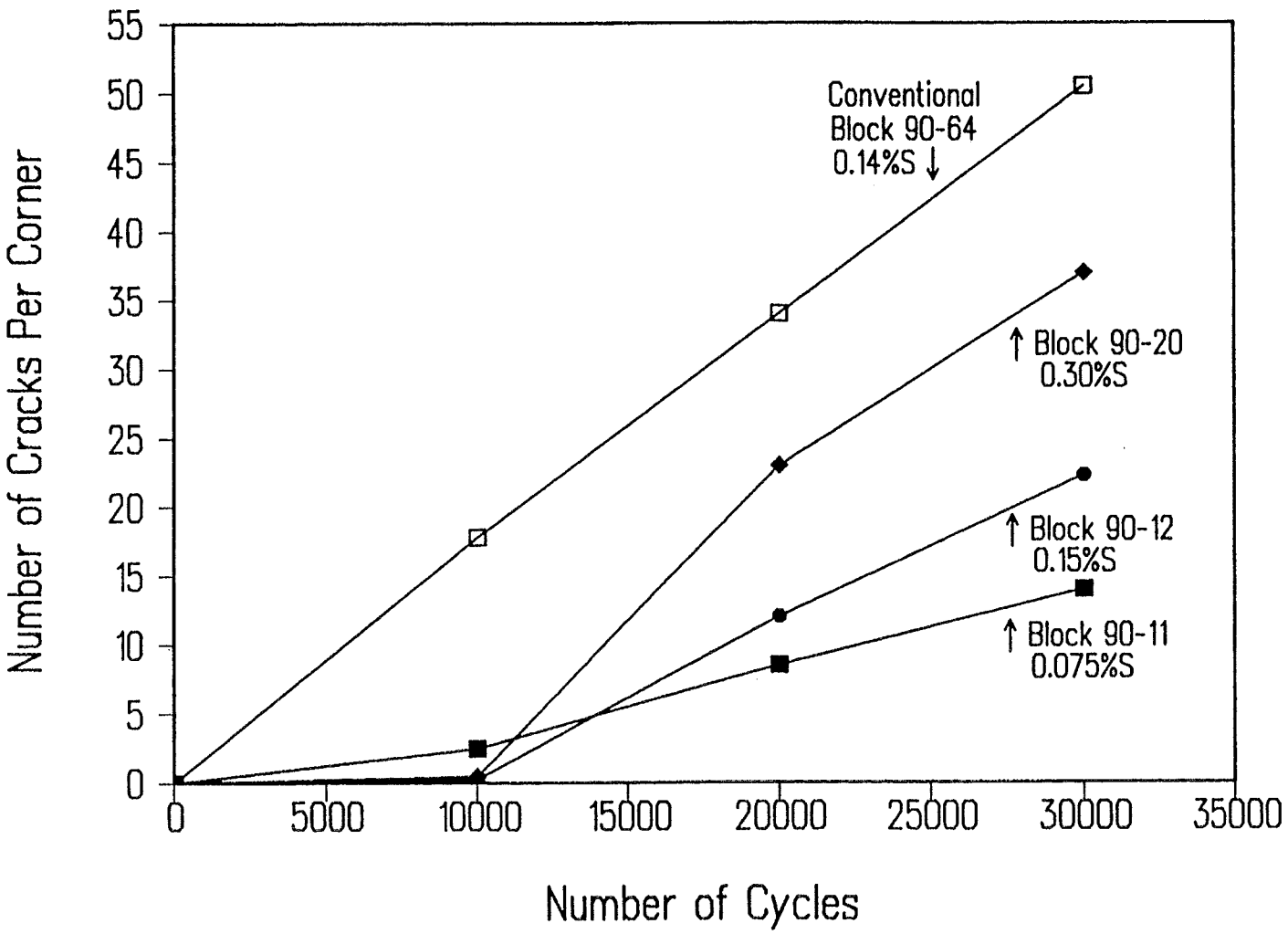
FIG. 9 is a graph showing the results of a thermal fatigue tests on samples of a conventional hot work tool steel die block and samples in accordance with the invention.

The results of thermal fatigue tests conducted on the die blocks of the invention and on the commercial, prehardened die block are shown in FIG. 9.

This test is conducted by immersing the set of specimens alternately into a bath of molten aluminum maintained at 1250° F. and a water bath at approximately 200° F. At regular intervals, the specimens are removed and microscopically examined for the presence of thermal fatigue cracks that form at the corners of the rectangular cross sections of the specimens. Cracks in excess of 0.015 inch are counted, and a higher average numbers of cracks per corner indicates poorer resistance to thermal fatigue cracking. The cyclic nature of the test simulates the thermal cycling that die casting die components and other hot work cooling components experience as they are alternately heated by contact with hot work pieces and cooled by water or air cooling. The results presented in FIG. 9 clearly show the superior thermal fatigue resistance of the die blocks of the invention in contrast to that of the commercial, prehardened die block.

The superior impact toughness and thermal fatigue resistance of the die blocks of the invention are believed to result from the fact that the sulfides which exist in the die blocks of the invention are smaller and more uniformly distributed through the material compared to those in the commercial, prehardened die block. The maximum size of the sulfides in the die blocks of the invention is less than about 50 microns in their longest dimension. Typically, the sulfides are manganese sulfides resulting from the manganese and sulfur conventionally present in steels of this type; however, other sulfide-forming elements, such as calcium, might also be present and combine with sulfur to form sulfides without adversely affecting the objects of the invention and the improved properties thereof. Hence, the presence of additional sulfide-forming elements are intended to be within the scope of the invention.

Nitrogen may be substituted for a portion of the carbon within the scope of the invention, and tungsten may be substituted for molybdenum in a ratio of 2:1.

All percentages are in weight percent unless otherwise indicated.

We claim:

1. A martensitic hot work tool steel die block article adapted for use in the manufacture of die casting die components and other hot work tooling components, said article having a hardness within the range of 35 to 50 HRC, and a minimum transverse Charpy V-notch impact toughness of 5 foot-pounds when heat treated to a hardness of 44 to 46 HRC and when tested at both 72° F. and at 600° F., said article comprising a hot worked heat treated and fully dense consolidated martensitic hot work tool steel mass of prealloyed particles having 0.05 to 0.30 weight percent sulfur said martensitic steel die block having sulfide particles with a maximum size of 50 microns in their longest direction.

2. A martensitic hot work tool steel die block article adapted for use in the manufacture of die casting die components and other hot work tooling components, said article having a hardness within the range of 35 to 50 HRC, and a minimum transverse Charpy V-notch impact toughness of 5 foot-pounds when heat treated to a hardness of 44 to 46 HRC and when tested at both 72° F. and at 600° F., said article comprising a hot worked, heat treated and fully dense consolidated mass of prealloyed particles consisting essentially of, in weight percent, 0.32 to 0.45 carbon, 0.20 to 2.00 manganese, 0.05 to 0.30 sulfur, up to 0.03 phosphorus, 0.80 to 1.20 silicon, 4.7 to 5.70 chromium, 1.10 to 1.75 molybdenum, 0.80 to 1.20 vanadium, balance iron and incidental impurities.

3. A martensitic hot work tool steel die block article adapted for use in the manufacture of die casting die components and other hot work tooling components, said article having a hardness within the range of 35 to 50 HRC and a minimum transverse Charpy V-notch impact toughness of 5 foot-pounds when heat treated to a hardness of 44 to 46 HRC and when tested at both 72° F. and at 600° F., said article comprising a hot worked, heat treated and fully dense consolidated mass of prealloyed particles comprising a chemical composition of a wrought AISI hot work tool steel to which sulfur has been added within the range of 0.05 to 0.30 weight percent.

4. A martensitic steel die article adapted for use in the manufacture of die casting die components and other hot work tooling components, said article having a hardness within the range of 35 to 50 HRC and a minimum transverse Charpy V-notch impact toughness of 5 foot pounds when heat treated to a hardness of 44 to 46 HRC and when tested at both 72° F. and at 600° F., said article comprising a hot worked, heat treated and fully dense consolidated mass of prealloyed particles comprising a chemical composition of a wrought maraging or precipitation-hardening steel which is suitable for use as die casting die components and other hot work tooling components and to which sulfur has been added within the range of 0.05 to 0.30 weight percent.

5. A martensitic steel die block article of claims 2, 3 or 4 in which the maximum size of the sulfide particles is 50 microns in their longest dimension.

6. A martensitic steel die block article of claims 2, 3 or 4 in which the sulfur content is within the range of 0.15 to 0.30 weight percent.

7. A method for manufacturing a martensitic hot work tool steel die block article adapted for use in the manufacture of die casting die components and other hot work tooling components, the article having a hardness within the range of 35 to 50 HRC, and a minimum transverse Charpy V-notch impact toughness of 5 foot pounds when heat treated to a hardness of 44 to 46 HRC and when tested at both 72° F. and at 600° F., with the article comprising a hot worked, heat treated and fully dense consolidated mass of prealloyed particles consisting essentially of, in weight percent, 0.32 to 0.45 carbon, 0.20 to 2.00 manganese, 0.05 to 0.30 sulfur, up to 0.03 phosphorous, 0.80 to 1.20 silicon, 4.75 to 5.70 chromium, 1.10 to 1.75 molybdenum, 0.80 to 1.20 vanadium, balance iron and incidental impurities;

said method comprising producing said prealloyed particles by gas atomization, hot isostatic compacting the prealloyed particles to full density to form a compact, hot working the compact to a desired shape of said article, annealing said article, hardening said article by heating and cooling to produce a martensitic structure, and tempering said article, which tempering includes at least a double tempering treatment with intermediate cooling to ambient temperature.

8. A method for manufacturing a martensitic hot work steel die block article adapted for use in the manufacture of die casting die components and other hot work tooling components, the article having a hardness within the range of 35 to 50 HRC and a minimum transverse Charpy V-notch impact toughness of 5 foot pounds when heat treated to a hardness of 44 to 46 HRC and when tested both at 72° F. and at 600° F., with the article comprising a hot worked, heat treated and fully dense consolidated mass of prealloyed particles comprising a chemical composition of wrought AISI hot work tool steel to which sulfur has been added within the range of 0.05 to 0.30 weight percent;

said method comprising producing said prealloyed particles by nitrogen gas atomization, hot isostatic compacting the prealloyed particles to full density to form a compact, hot working the compact to a desired shape of said article, annealing said article, hardening said article by heating and cooling to produce a martensitic structure, and tempering said article, which tempering includes at least a double tempering treatment with intermediate cooling to ambient temperature.

9. A method for manufacturing a martensitic die steel article adapted for use in the manufacture of die casting die components and other hot work tooling components, the article having a hardness within the range of 35 to 55 HRC and a minimum transverse Charpy V-notch impact toughness of 5 foot pounds when heat treated to a hardness of 44 to 46 HRC and when tested at both 72° F. and 600° F., the article comprises a hot worked, heat treated and fully dense consolidated mass of prealloyed particles comprising a chemical composition of a wrought maraging or precipitation-hardening steel suitable for use as die casting die components and other hot work tooling components and to which sulfur has been added within the range of 0.05 to 0.30 weight percent;

said method comprising producing said prealloyed particles by gas atomization, hot isostatic compacting the prealloyed particles to full density to form a compact, hot working the compact to a desired shape of said article, solution annealing said article to produce a martensitic structure, and age hardening said article to working hardness by heating and cooling.

10. The method of claims 7, 8 or 9 in which the maximum size of the sulfide particles is 50 microns in a longest direction thereof.

11. The method of claims 7, 8, or 9 in which the sulfur content is within the range of 0.15 to 0.30 weight percent.

12. The method of claims 7, 8 or 9 wherein said hot isostatic pressing is conducted for up to 12 hours within a temperature range of 1800° to 2400° F. and at a pressure in excess of 10,000 psi, said hot working is performed within the temperature range of 1800° to 2250° F., said annealing is performed at a temperature within the range of 1550° to 1700° F. with cooling from annealing temperature being at a rate less than 50° F. per hour, said hardening being by heating to a temperature within the range of 1800° to 1950° F. for about ½-hour per inch of thickness and cooling is at a minimum rate of 20° F. per minute to provide said martensitic structure and said tempering is conducted within the range of 1000° to 1200° F. for about 1 hour per inch of thickness for a maximum of 2 hours for each temper.

13. The method of claim 9 wherein said compacting is hot isostatic pressing for up to 12 hours within a temperature range of 1800° to 2400° F. and at a pressure up to 10,000 psi, said hot working is within a temperature range of 1800° to 2300° F., said solution annealing is within a temperature range of 1500° to 1900° F. with cooling from solution annealing temperature at a rate at least equal to that achieved in still air and said age hardening is by heating to a minimum temperature of 900° F. and holding at said temperature for a minimum of one hour.

* * * * *